US010806989B2

(12) United States Patent
Johnson

(10) Patent No.: US 10,806,989 B2
(45) Date of Patent: Oct. 20, 2020

(54) QUICK-RELEASE TRUCK SYSTEM

(71) Applicant: Erik Brent Johnson, Coeur d'Alene, ID (US)

(72) Inventor: Erik Brent Johnson, Coeur d'Alene, ID (US)

( * ) Notice: Subject to any disclaimer, the term of this patent is extended or adjusted under 35 U.S.C. 154(b) by 0 days.

(21) Appl. No.: 16/354,061

(22) Filed: Mar. 14, 2019

(65) Prior Publication Data

US 2019/0282888 A1 Sep. 19, 2019

Related U.S. Application Data

(63) Continuation-in-part of application No. 16/129,034, filed on Sep. 12, 2018, now abandoned.

(60) Provisional application No. 62/643,278, filed on Mar. 15, 2018.

(51) Int. Cl.
*A63C 17/01* (2006.01)
*A63C 17/00* (2006.01)

(52) U.S. Cl.
CPC ..... *A63C 17/017* (2013.01); *A63C 17/0093* (2013.01); *A63C 17/012* (2013.01)

(58) Field of Classification Search
CPC .... A63C 17/017; A63C 17/012; A63C 17/015
See application file for complete search history.

(56) References Cited

U.S. PATENT DOCUMENTS

| | | | | |
|---|---|---|---|---|
| 7,070,193 | B2 * | 7/2006 | Yamaguchi | A63C 17/0086 280/11.26 |
| 7,243,925 | B2 * | 7/2007 | Lukoszek | A63C 17/0093 280/11.28 |
| 7,837,204 | B1 * | 11/2010 | Groenenboom | A63C 17/0093 280/11.27 |
| 8,936,263 | B2 * | 1/2015 | Rawlins | A63C 17/0093 280/87.042 |
| 2004/0041360 | A1 * | 3/2004 | Lukoszek | A63C 17/0093 280/11.27 |
| 2007/0029750 | A1 * | 2/2007 | Gregory | A63C 17/0086 280/87.042 |
| 2016/0175693 | A1 * | 6/2016 | Page | A63C 17/26 280/87.042 |
| 2018/0296906 | A1 * | 10/2018 | Quick | A63C 17/01 |

* cited by examiner

*Primary Examiner* — Brian L Swenson
(74) *Attorney, Agent, or Firm* — US IP Attorneys, P.C.; Timothy Marc Shropshire

(57) ABSTRACT

A quick-release truck system includes a deck plate, a truck plate, and a locking mechanism for releasably locking the truck plate to the deck plate. The deck plate mounts to an underside of a deck of a rideable vehicle, and the truck plate mounts to, or is integrated into, an upper surface of a truck baseplate. The deck plate and the truck plate slidingly engage one another using vertically-staggered complementary coupling means. The coupling means may further be horizontally-staggered to create a tiered configuration. The coupling means include a combination of rails and grooves. Once fully engaged, the truck plate releasably locks to the deck plate. The deck plate and the truck plate may include cut-outs for weight reduction.

20 Claims, 22 Drawing Sheets

QUICK-RELEASE TRUCK SYSTEM

CROSS-REFERENCE TO RELATED APPLICATION(S)

The present application is a continuation-in-part of, and claims priority to, U.S. Nonprovisional Utility patent application Ser. No. 16/129,034 filed on Sep. 12, 2018, entitled "QWIK TRUKS", and further claims benefit of U.S. Provisional Utility Patent Application No. 62/643,278 filed on Mar. 15, 2018, entitled "QWIK TRUKS", the entire disclosures of which are incorporated by reference herein.

BACKGROUND OF THE INVENTION

Field of Invention

The present invention relates to rideable vehicles, such as skateboards, snowskates, and scooters. More particularly, the present invention relates to a tool-less system for releasably locking trucks to rideable vehicle decks.

Description of Related Art

Quick-release and quick-adjusting truck assemblies for rideable vehicles, such as skateboards, snowskates, and scooters, are known but are inconvenient to use and result in undesired restrictions and/or disadvantages in performance. For example, current quick-release truck assemblies are designed for transit boards, e.g., long boards, that are not intended for performing tricks. They are not engineered to withstand high impact forces, such as those associated with performing tricks. Likewise, they are not designed to prevent inadvertent or unexpected disengagement, i.e., to ensure that they remain locked in place when performing tricks. The following represents a list of known art related to quick-release and/or quick-adjusting truck assemblies for rideable vehicles.

U.S. Pat. No. 7,837,204 to Groenenboom teaches a hanger and kingpin angle adjustment apparatus for a skateboard or scooter. The hanger and kingpin angle adjustment apparatus includes a truck, a truck base plate attached to said truck, and a curving track adjustably connected to said truck base plate to adjust the vertical angle of the truck in relation to the board. Groenenboom's apparatus is designed to allow a skateboarder to vary the responsiveness of the skateboard by varying the vertical angle of one or both trucks in relation to the board.

U.S. Pat. Pub. No. 2004/0041360 to Lukoszek teaches a truck assembly for a skateboard, having a main truck body adapted to be mounted to the underside of the deck of a skateboard via a mounting block. Complementary coupling means are provided on the truck body and mounting block which allow the truck body to slidably engage the mounting block. The complementary coupling means includes a rib and groove type coupling having a pair of opposite parallel ribs or edges on the lower side of the truck body and a pair of opposed parallel grooves on the upper side of the mounting block. Further, a single-action releasable latch means for latching the components together in a desired combination is disclosed.

U.S. Pat. Pub. No. 2007/0029750 to Gregory teaches a skateboard that may be easily assembled and disassembled without tools. Gregory discloses a multiple section deck having one or more mounting mechanisms thereon that are configured for releasably mounting a truck mounting assembly thereto so as to join two deck sections together. In the preferred embodiment, the truck mounting assembly and mounting mechanism are configured for twist-and-lock engagement. One or more securing mechanisms are utilized to secure the truck mount to the truck mount connector and the deck.

While the foregoing body of art indicates it to be well-known to have a means for quickly releasing truck assemblies from decks of rideable vehicles, the art described herein above does not teach or suggest a quick-release truck system that has the following desirable features, either individually or in combination: (1) a truck plate removably mountable to a truck, whereby the truck plate matingly engages a deck plate for efficient, tool-less retrofitment of any set of trucks to any deck; (2) a dual-action locking mechanism for releasably locking the truck plate to the deck plate; and/or (3) multiple securing/coupling means for securing the deck plate to the truck plate.

Based on the foregoing, there is a need in the art for a quick-release truck system that offers retrofitment capabilities and enhanced structural integrity, such that it can withstand high impact forces and provide efficient adaptability to various riding conditions as needed or desired.

SUMMARY OF THE INVENTION

In an embodiment, the quick-release truck system includes a deck plate, a truck plate, and a locking means for releasably coupling, i.e., locking, the deck plate to the truck plate. The deck plate is configured to mount to an underside of a deck of the rideable vehicle and the truck plate is configured to mount to an upper surface of a truck baseplate.

In an embodiment, the deck plate has one or more channels for receiving and housing the locking means. A cavity extends into a lower surface of the deck plate, wherein the one or more channels are in open communication with the cavity. A plurality of first coupling means are disposed within the cavity. The truck plate has a plurality of second coupling means, dimensioned and spaced to complement the first coupling means. One or more lock stops extend into one or more of the second coupling means. The truck plate is configured to slide into or onto the deck plate. Once fully engaged, the locking means releasably engages the one or more lock stops to lock the truck plate to the deck plate.

In an embodiment, the first and second coupling means are vertically-staggered and are spaced and dimensioned to complement one another. In a further embodiment, the cavity and the upper surface of the truck plate have complementary tiered configurations, such that the first and second coupling means are also staggered horizontally. In an embodiment, at least one tier of the cavity and at least one tier of the truck plate's upper surface have a substantially triangular shape.

In an embodiment, the first coupling means are grooves and the second coupling means are rails. In another embodiment, the first coupling means are rails and the second coupling means are grooves. In yet another embodiment, the first and second coupling means each include a combination of rails and grooves that are configured to matingly engage one another as the truck plate is slid into or onto the deck plate.

In an embodiment, the truck plate is integrated into the baseplate of a truck. For example, it may be machined, molded, or otherwise formed as an integrated portion of the baseplate, such that it is not removable from the baseplate.

In an embodiment, one or more of the deck plate coupling means extend along three contiguous surfaces of the cavity, and one or more truck plate coupling means extend along three contiguous surfaces of the truck plate.

In an embodiment, each of the channels extend into a side and an upper surface of the deck plate. In an embodiment, there are two channels, wherein the channels extend into opposing sides of the deck plate.

In an embodiment, the truck plate and the deck plate have one or more cut-outs configured to reduce an overall weight of the system.

The foregoing and other features and advantages of the invention will be apparent from the following, more particular description of the preferred embodiments of the invention, the accompanying drawings, and the claims.

BRIEF DESCRIPTION OF THE DRAWINGS

For a more complete understanding of the present invention, the objects and advantages thereof, reference is now made to the ensuing descriptions taken in connection with the accompanying drawings briefly described as follows.

DETAILED DESCRIPTION OF PREFERRED EMBODIMENTS

Figure 1:
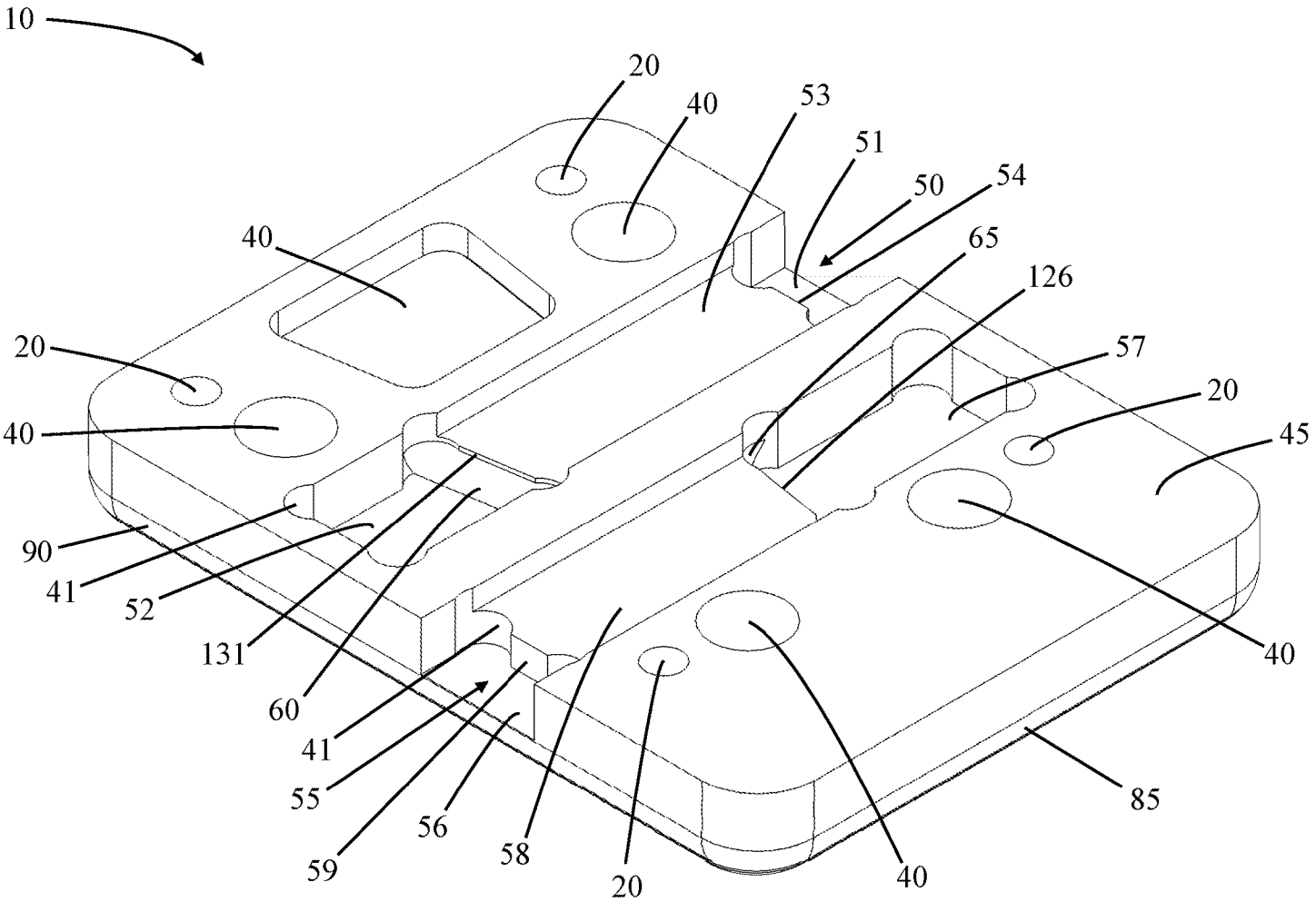
FIG. 1 shows a top perspective view of the deck plate, according to an embodiment of the present invention.
Figure 2:
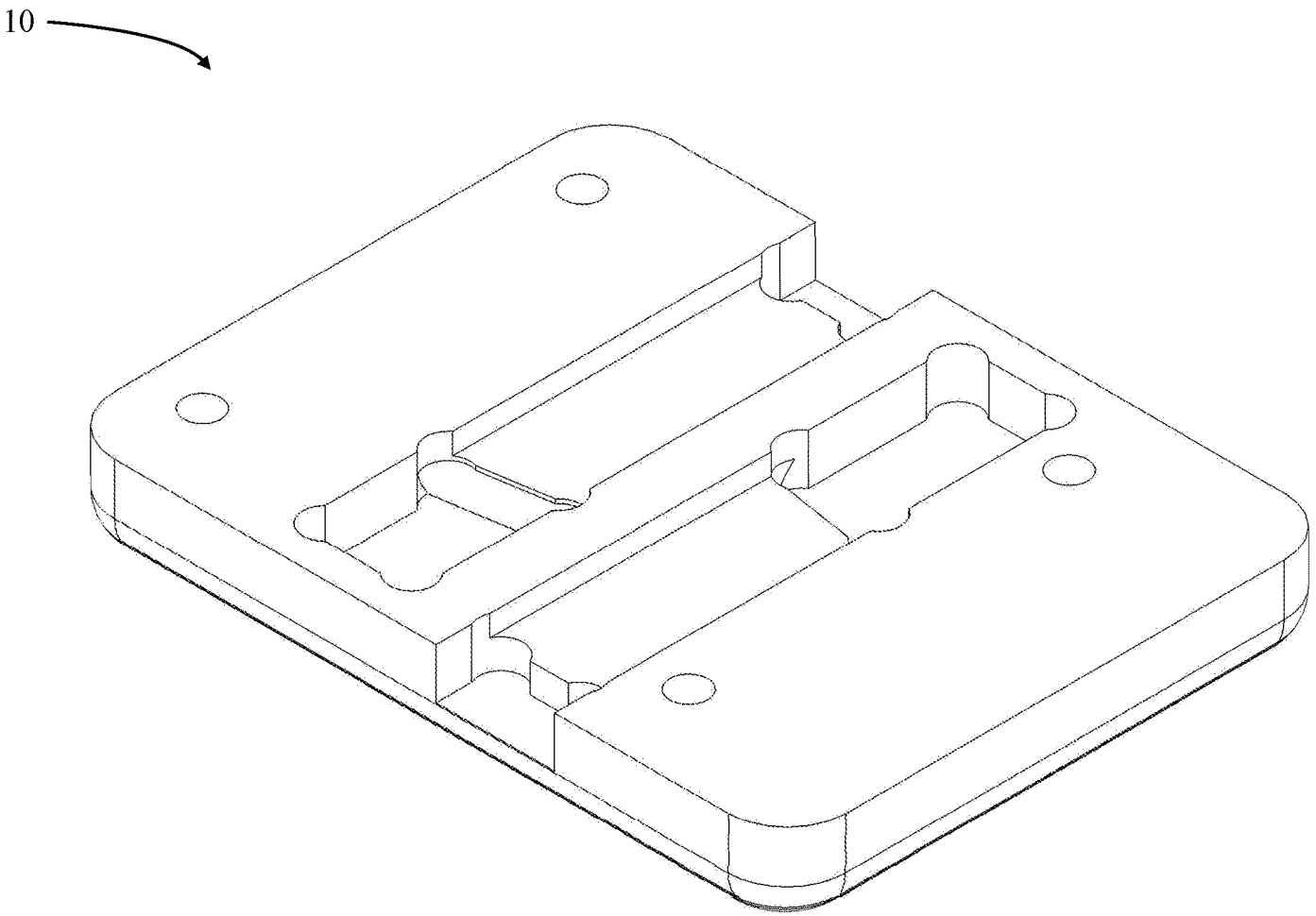
FIG. 2 shows a top perspective view of the deck plate, according to an embodiment of the present invention.

Preferred embodiments of the present invention and their advantages may be understood by referring to FIGS. 1-22 wherein like reference numerals refer to like elements.

With reference to FIGS. 1-22, quick-release truck system 5 includes deck plate 10 and truck plate 15, each having a substantially rectangular footprint. Deck plate 10 is adapted to couple to the deck of a rideable vehicle (not shown), and truck plate 15 is adapted to couple to a truck of a rideable vehicle (not shown). Deck plate 10 and truck plate 15 each include a plurality of screw holes 20, 25 to facilitate coupling the respective plate 10, 15 to a given deck or truck. Screw holes 20, 25 may be threaded or unthreaded.

Complementary coupling means are provided on deck plate 10 and truck plate 15 that allow them to be slidably interengaged. The complementary coupling means include multiple pairs of vertically and horizontally staggered mating rails and grooves. In use, truck plate 15 slidingly engages, and couples to, deck plate 10. As truck plate 15 slides into place on deck plate 10, locking means releasably engage truck plate 15 to lock it in place on deck plate 10. In a preferred embodiment, locking means include lock bars 30, 35.

With reference to FIGS. 1, 3, 7, 9, 10, and 20-21, in the preferred embodiment, cut-outs 40 may be used to reduce the weight of quick-release truck system 5. Although the figures exemplify a specific configuration of cut-outs 40, one skilled in the art would understand and appreciate that alternative configurations and numbers of cut-outs 40 could be employed, depending on the desired result, without deviating from the scope of the present invention. For example, in an embodiment, as illustrated in FIGS. 2, 4, 8, and 11, deck plate 10 and truck plate 15 are exemplified without cut-outs 40.

Figure 7:
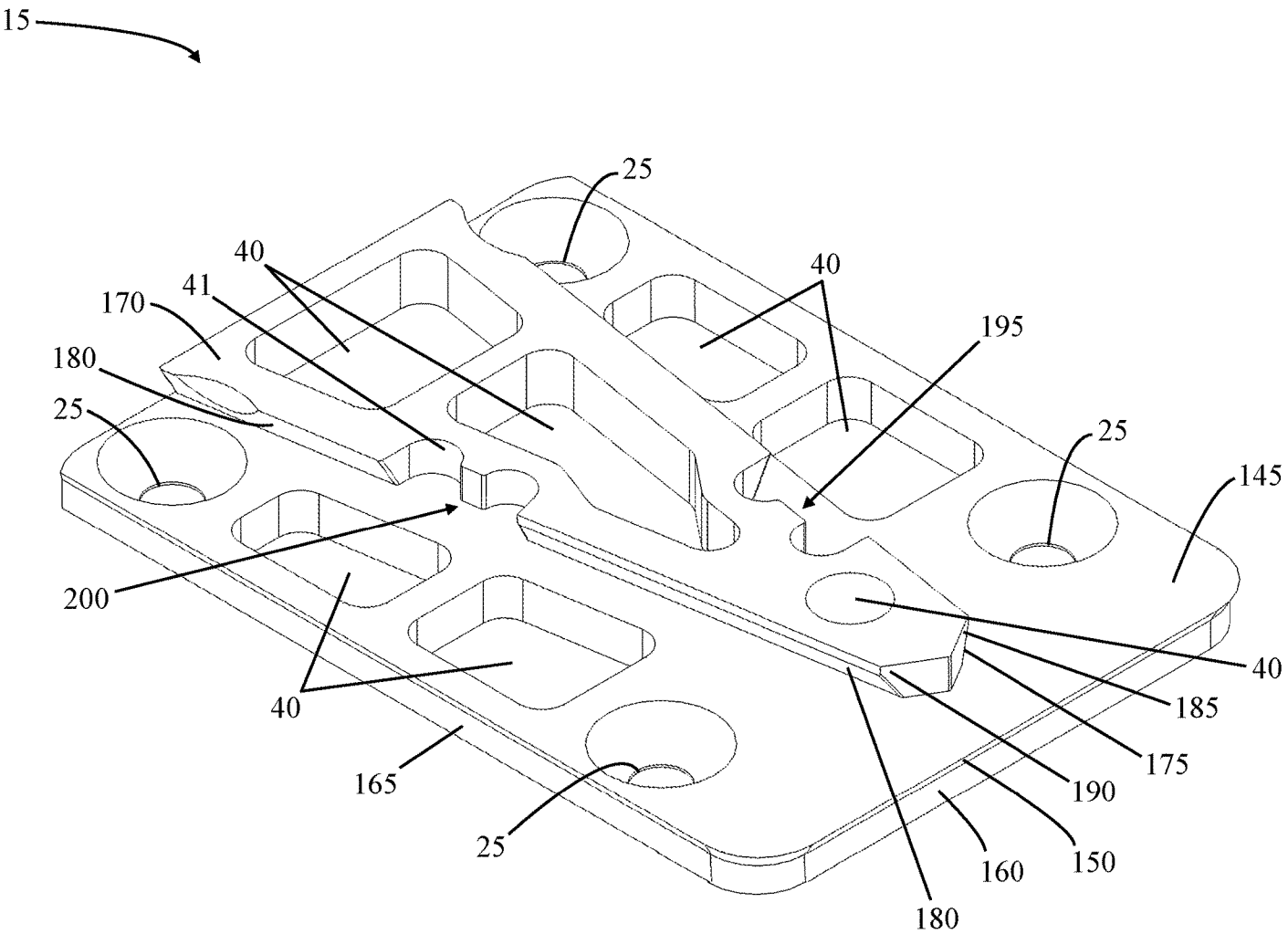
FIG. 7 shows a top perspective view of the truck plate, according to an embodiment of the present invention.
Figure 8:
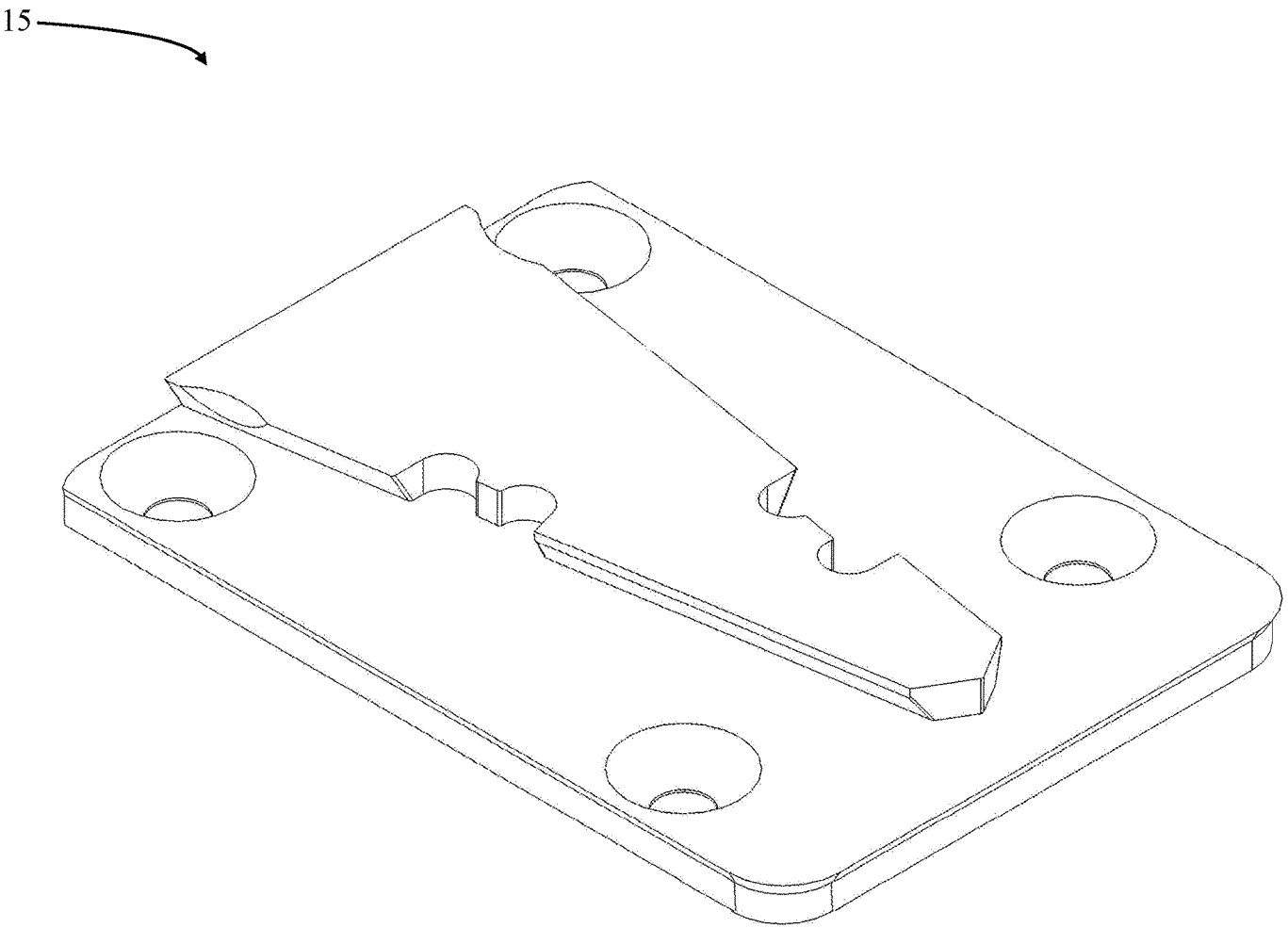
FIG. 8 shows a top perspective view of the truck plate, according to an embodiment of the present invention.
Figure 9:
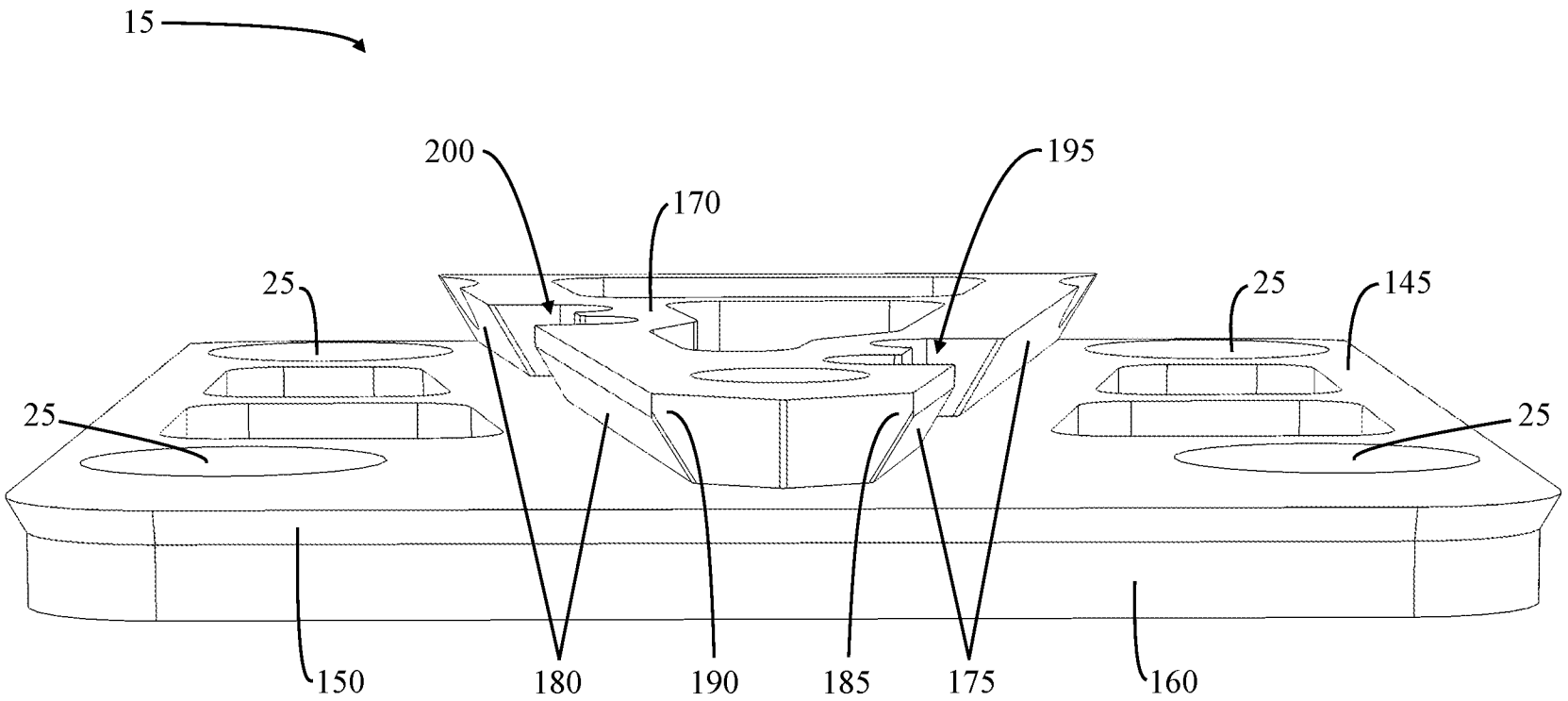
FIG. 9 shows a top perspective view of the truck plate, according to an embodiment of the present invention.
Figure 10:
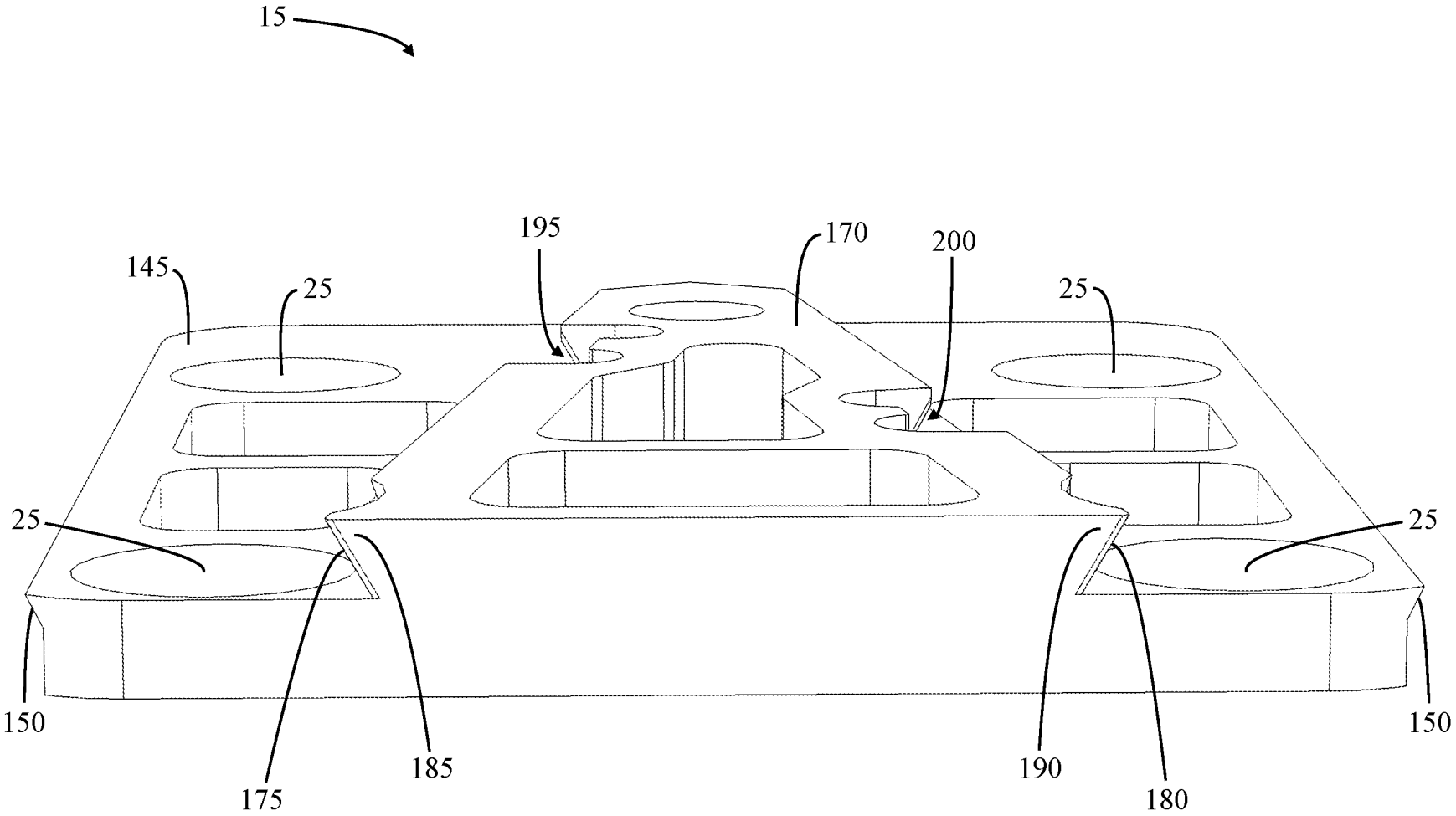
FIG. 10 shows a top perspective view of the truck plate, according to an embodiment of the present invention.
Figure 11:
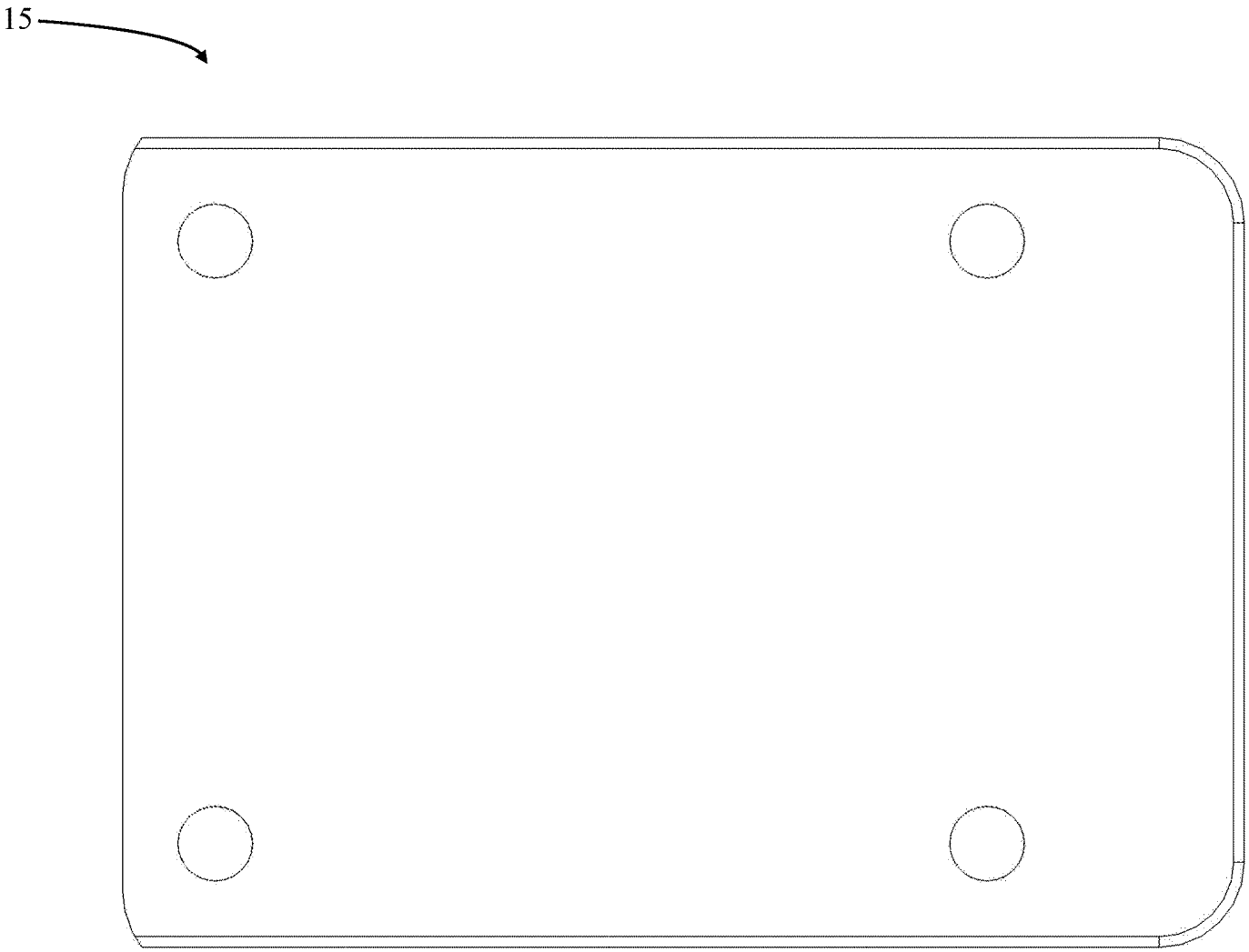
FIG. 11 shows a bottom plan view of the truck plate, according to an embodiment of the present invention.
Figure 12:
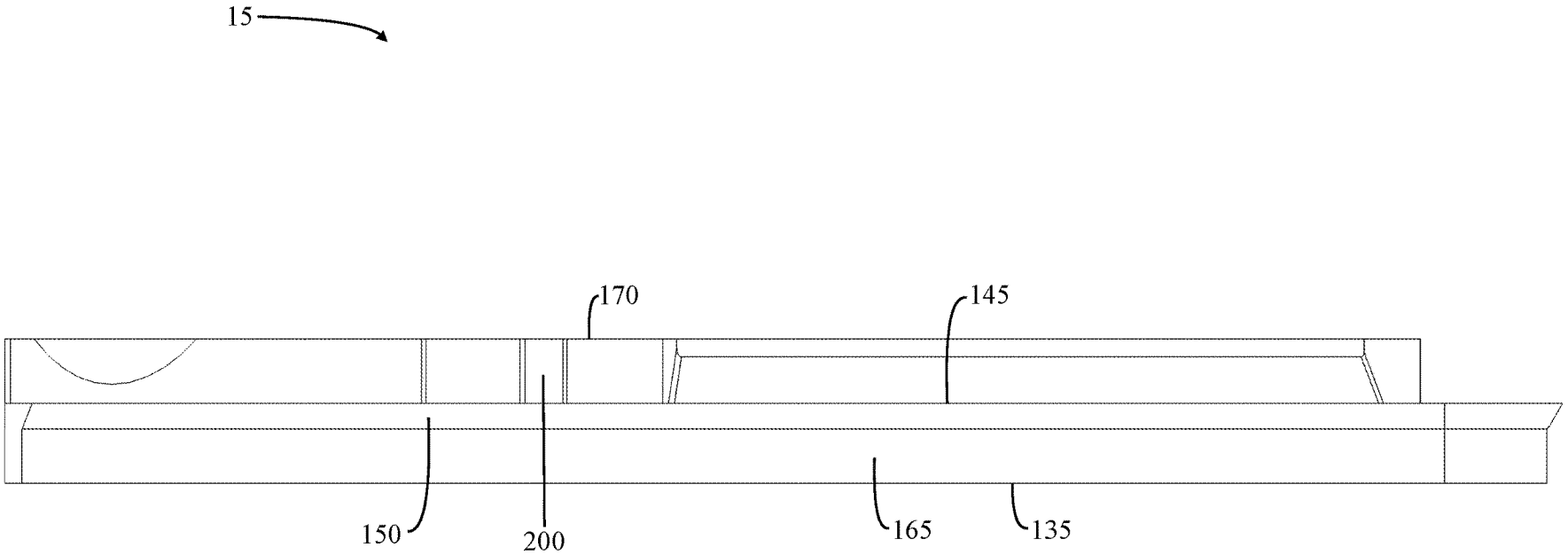
FIG. 12 shows a side elevational view of the truck plate, according to an embodiment of the present invention.
Figure 13:
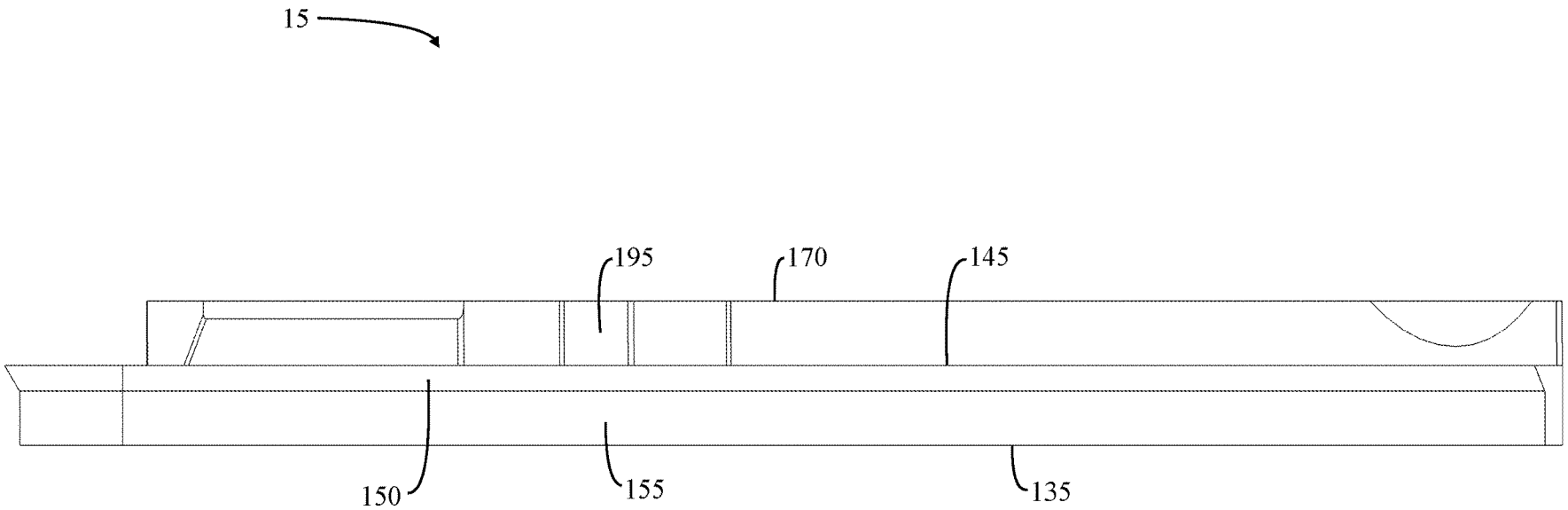
FIG. 13 shows a side elevational view of the truck plate, according to an embodiment of the present invention.

With reference to FIGS. 1 and 7, deck plate 10 and truck plate 15 may include pockets 41 to accommodate foreign debris that may get into the quick-release truck system 5. By including provision for debris collection, issues, e.g., the locking mechanism not seating properly or not fully engaging due to an obstruction caused by debris, are less likely to arise.

Following is a detailed description of each component of quick-release truck system 5.

Deck Plate

With reference to FIGS. 1-6 and 20-22, upper surface 45 of the deck plate 10 is substantially planar to enable a flush fitment with the underside of a deck when in use. Lock bar channels 50, 55 extend into the upper surface 45 from opposing sides of deck plate 10. Lock bar channels 50, 55 have a stepped configuration, whereby the longitudinal spans of terminal portions 51, 52, 56, 57 of lock bar channels 50, 55 are recessed deeper into upper surface 45 than the longitudinal span of respective lock bar channel central portions 53, 58. Apertures 60, 65 extend through deck plate 10 at an intersection of central portions 53, 58 and distally-located terminal portions 52, 57 of lock bar channels 50, 55.

Cavity 70 extends into the bottom of deck plate 10. Cavity 70 has a multi-tiered configuration, whereby each successive tier is set inward, both laterally and depth-wise, relative to the preceding tier. First tier 75 extends inward from the base of first, second, and third contiguous cavity side walls 80, 85, 90. An end of deck plate 10 opposite side wall 85 opens into cavity 70. Groove 95 extends into, and along, an inner surface of first, second, and third cavity side walls 80, 85, 90. Second tier 100 is elevated above first tier 75, i.e., it is recessed deeper into cavity 70, whereby first and second tiers 75, 100 are separated by opposing risers 105, 110. Risers 105, 110 extend obliquely between first and second tiers 75, 100 to form a pair of opposing retaining grooves 115, 120. Apertures 60, 65 open into second tier 100 and risers 105, 110, respectively.

Figure 3:
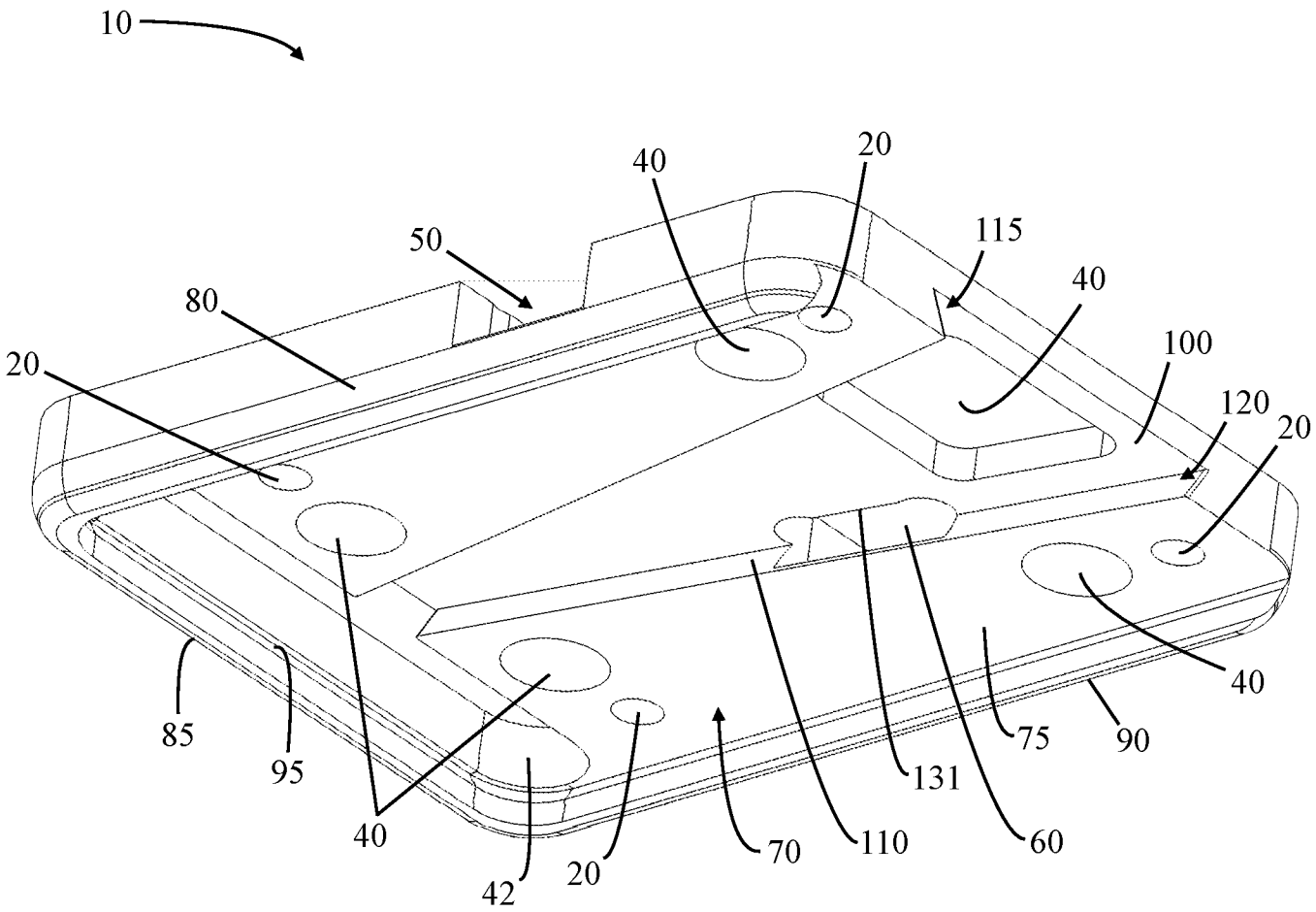
FIG. 3 shows a bottom perspective view of the deck plate, according to an embodiment of the present invention.
Figure 4:
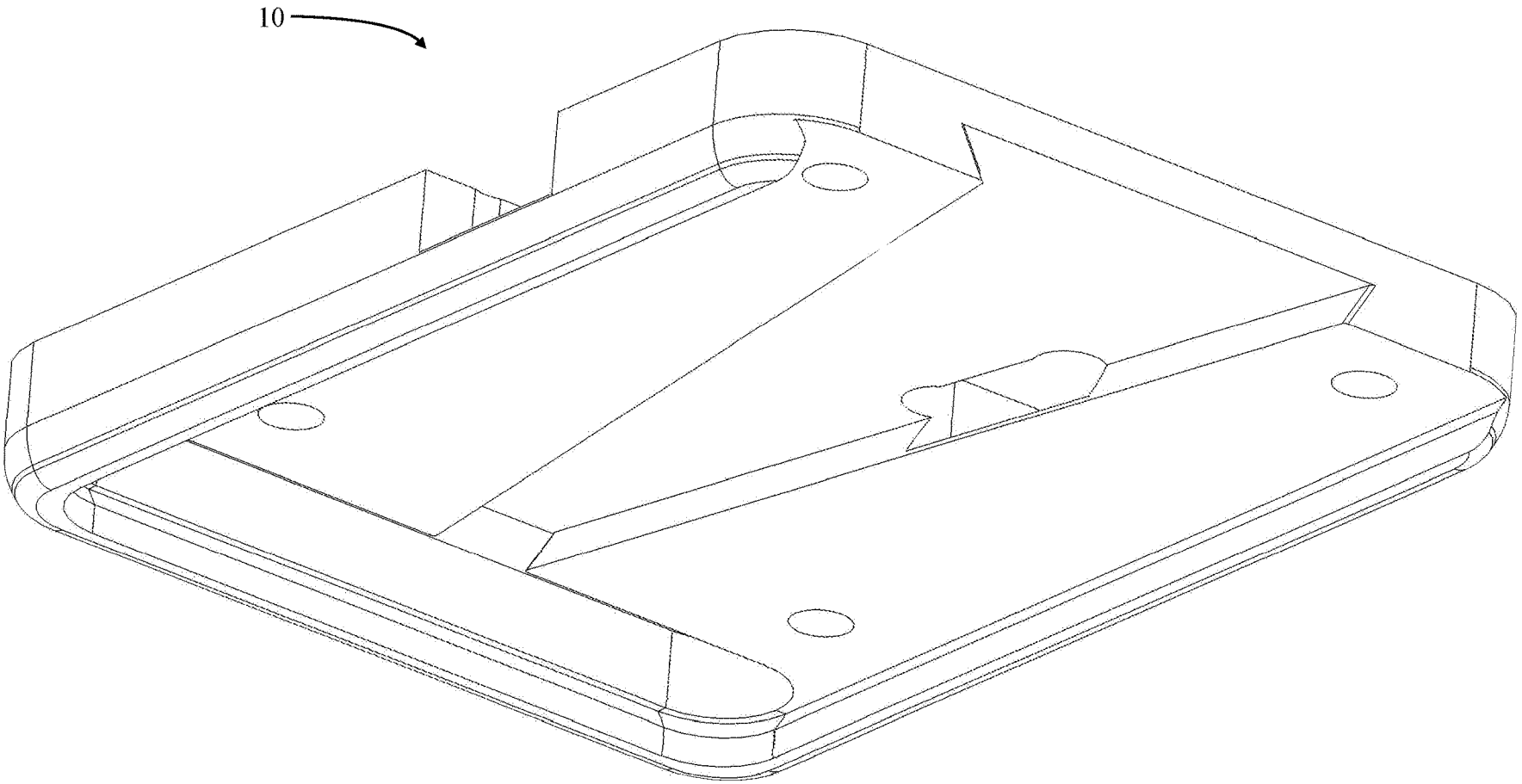
FIG. 4 shows a bottom perspective view of the deck plate, according to an embodiment of the present invention.
Figure 5:
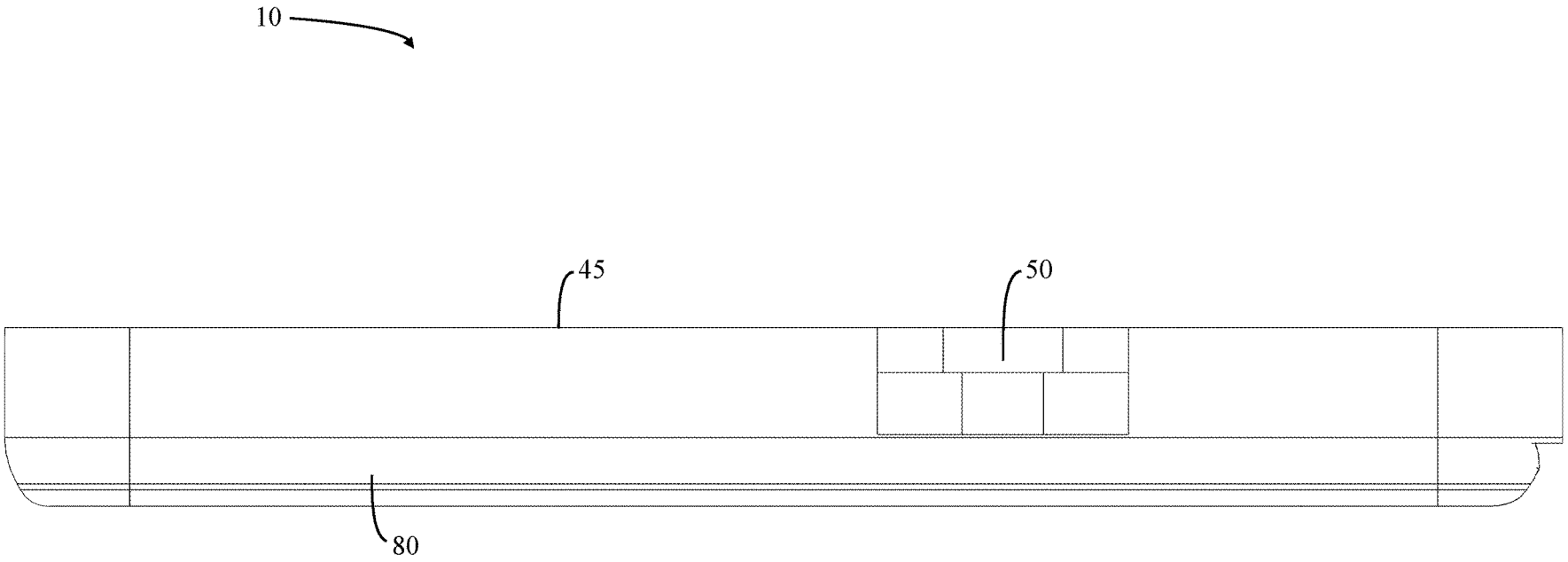
FIG. 5 shows a side elevational view of the deck plate, according to an embodiment of the present invention.
Figure 6:
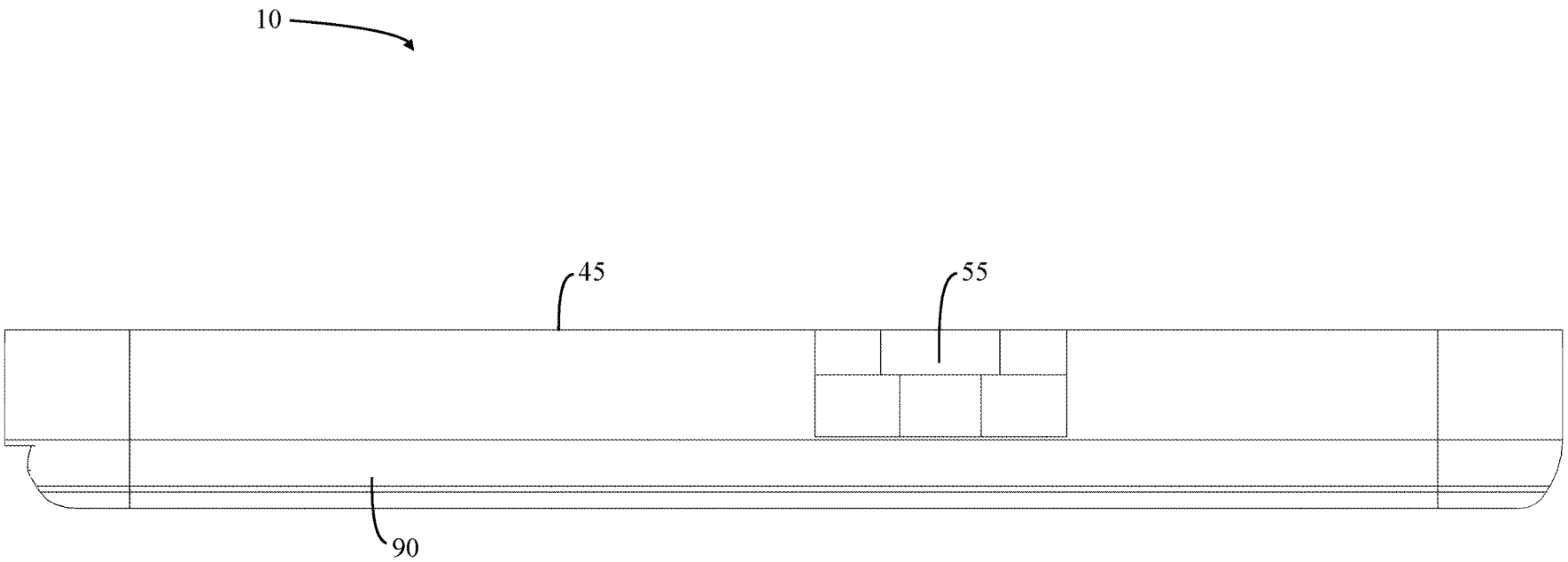
FIG. 6 shows a side elevational view of the deck plate, according to an embodiment of the present invention.
Figure 20:
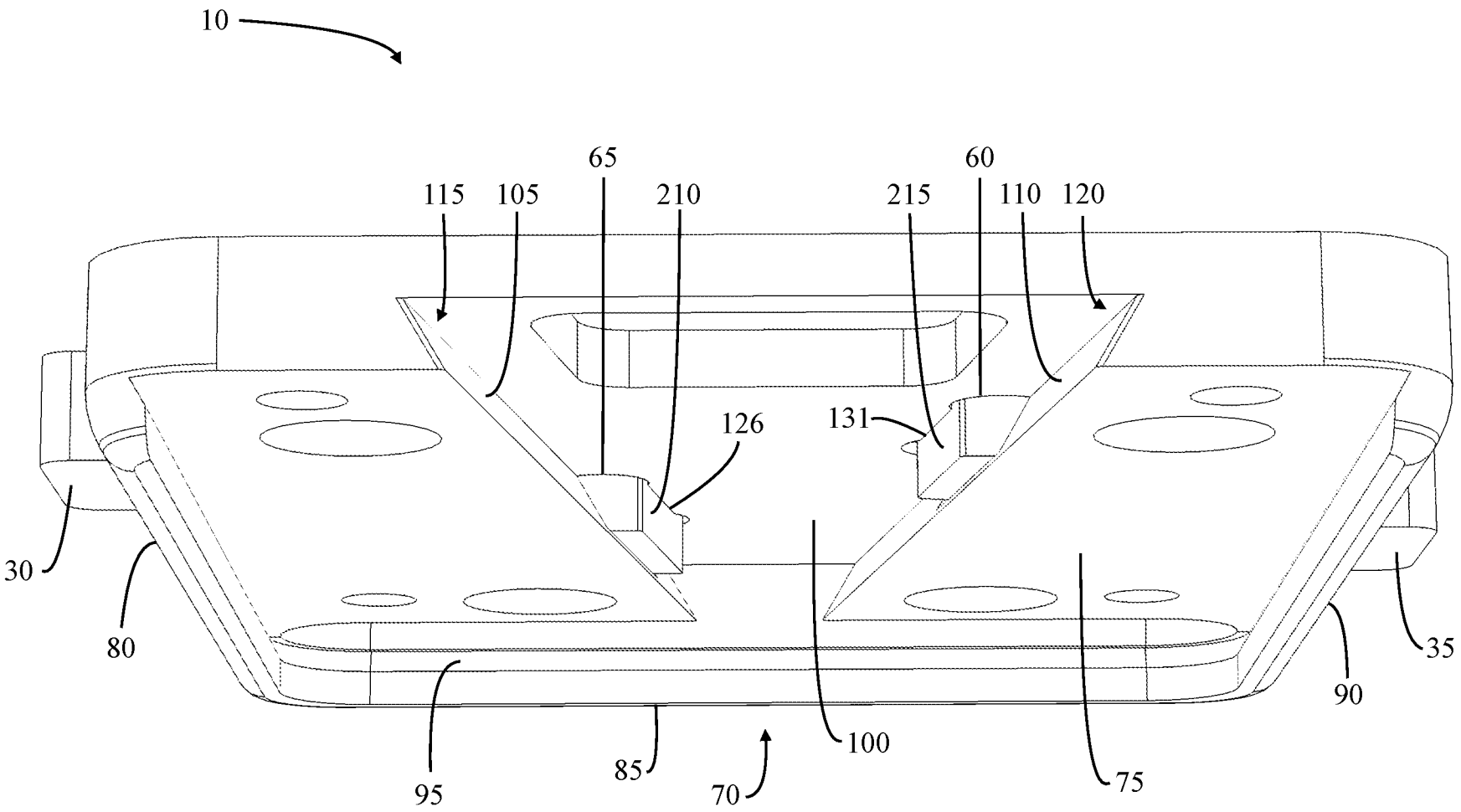
FIG. 20 shows a bottom perspective view of the deck plate with the lock bars seated in the lock bar channels, according to an embodiment of the present invention.
Figure 21:
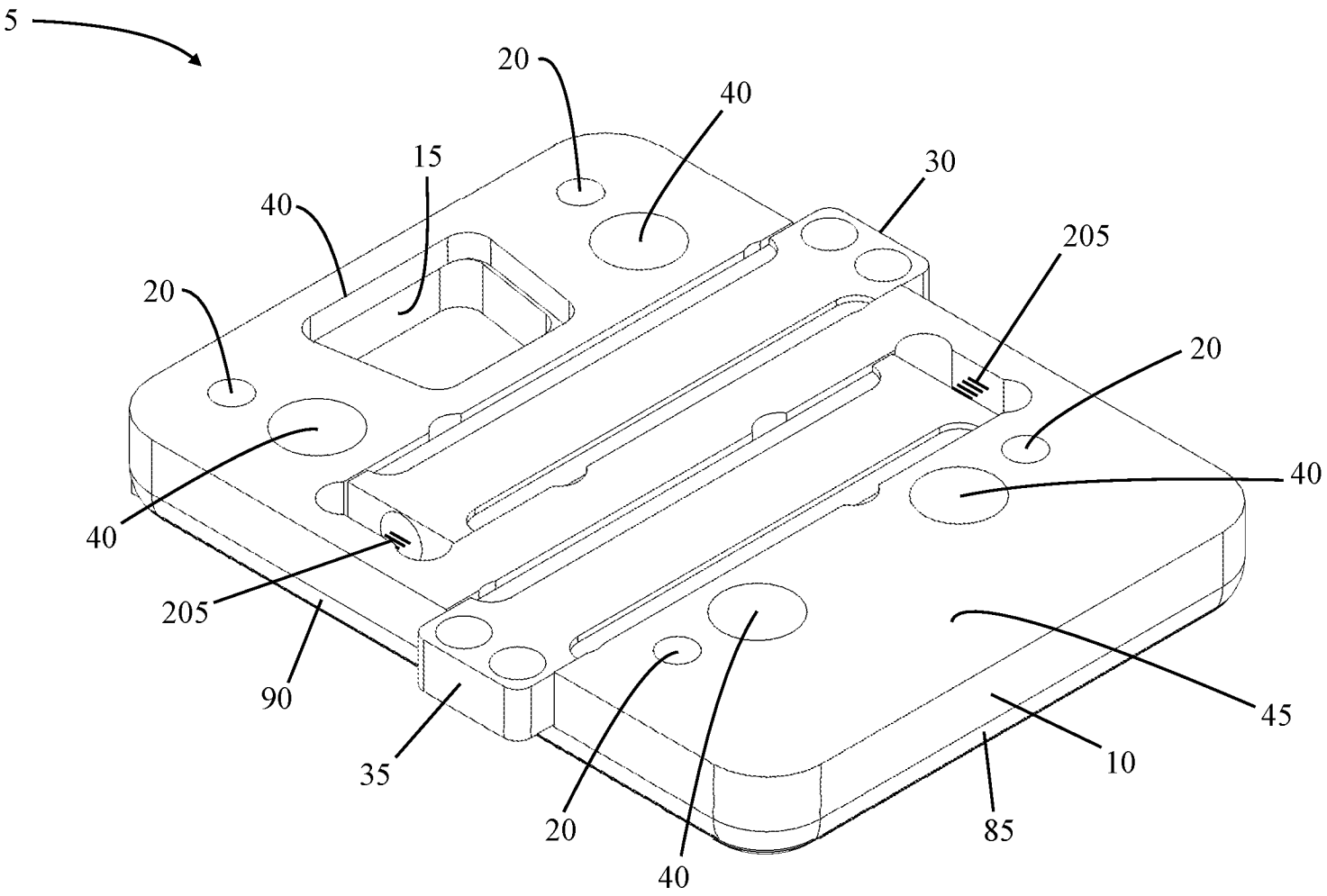
FIG. 21 shows a top perspective view of the deck plate and the truck plate in a locked position, according to an embodiment of the present invention.
Figure 22:
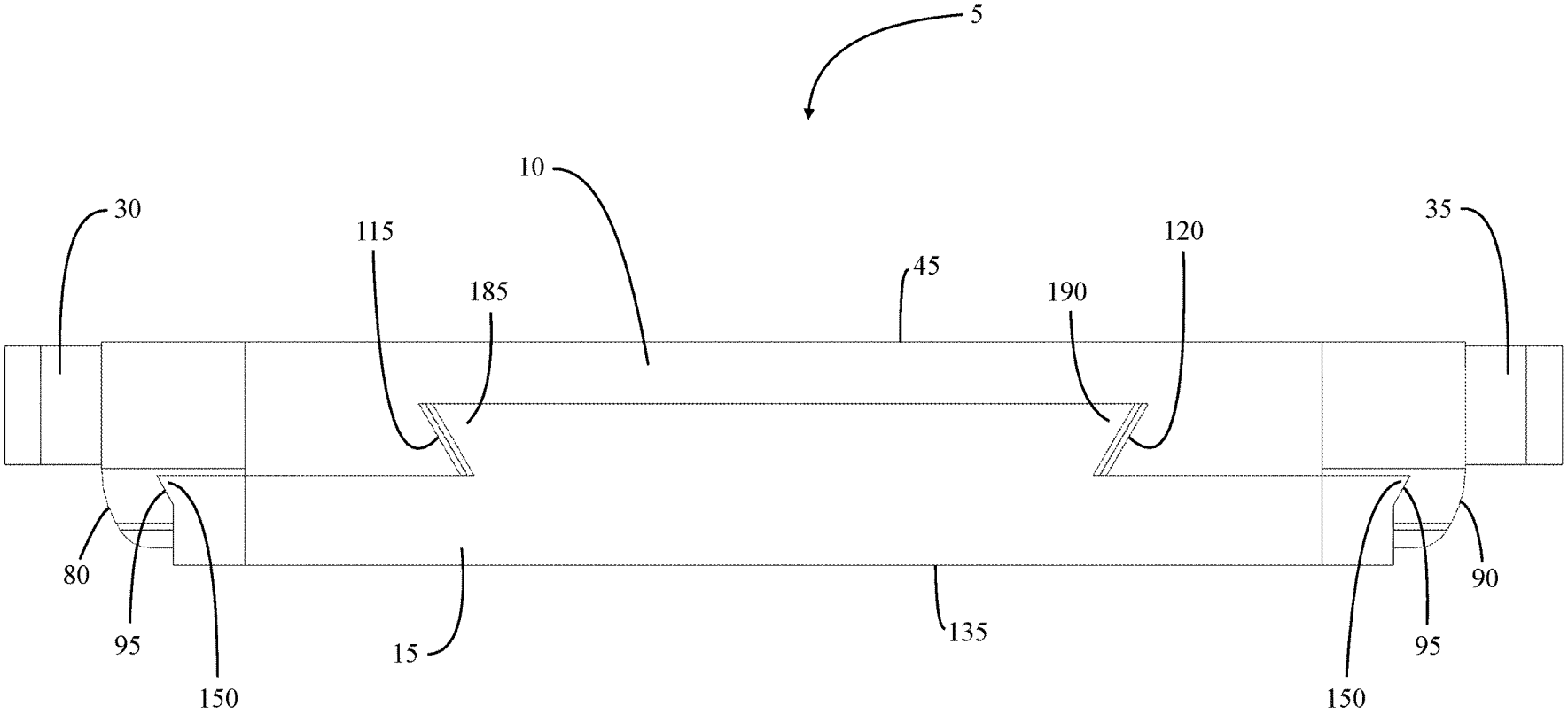
FIG. 22 shows an end elevational view of the deck plate and the truck plate in a locked position, according to an embodiment of the present invention.

With reference to FIGS. 3-4 and 20, in the preferred embodiment, the shape of second tier 100 is generally triangular. Among other things, the triangular shape allows second tier 100 to be horizontally inset, relative to first tier 75, providing a much thicker sidewall around second tier 100. As such, said sidewall is much less susceptible to damage, e.g., a crack or tear in the truck plate sidewall, due to shearing forces generated from high impact tricks, etc. However, one skilled in the art would understand and appreciate that second tier 100 could be configured in alternative shapes without deviating from the scope of the present invention.

With reference to FIG. 3, deck plate 10 may include compartment 42 at a distal portion of cavity 70. Compartment 42 may be used to store small items, e.g., tools. Additionally, and/or alternatively, a compressible member (not shown), e.g., a spring or a rubber bumper, may be disposed in compartment 42 to serve as a bumper for the distal portion of truck plate 15 as it is inserted into deck plate 10. Compression of the member causes an opposing force to be exerted against truck plate 15 as it is locked into place on deck plate 10, such that when disengaged, truck plate 15 is pushed out of or away from deck plate 10.

Truck Plate

With reference to FIGS. 11-13 and 22, truck plate lower surface 135 is substantially planar and is dimensioned substantially the same as a truck baseplate. This enables a substantially flush and seamless fitment between truck plate lower surface 135 and the upper surface of a truck baseplate when in use.

With reference to FIGS. 7-10, 12-13 and 22, truck plate upper surface has a tiered configuration, whereby each successive tier is more elevated and laterally recessed, relative to the preceding tier. First tier 145 is generally rectangular. Rail 150 extends radially from, and along, first, second, and third contiguous outermost walls 155, 160, 165 of truck plate 15. Second tier 170 is elevated above first tier 145. Risers 175, 180 extend obliquely between first and second tiers 145, 170 to form a pair of opposing rails 185, 190. Lock stops 195, 200 extend into rails 185, 190 and are configured to align with apertures 60, 65 when truck plate 15 is fully engaged with deck plate 10.

A distal portion of second tier 170, configured to initiate contact with lock bars 30, 35 as truck plate 15 is inserted into deck plate 10, is generally curved, rounded, or otherwise angled obliquely, relative to the longitudinal axis of truck plate 15, such that, as truck plate 15 is inserted into deck plate 10, it forces lock bars 30, 35 further into their respective lock bar channels 50, 55 and out of the way of rails 185, 190.

With reference to FIGS. 7-10, in the preferred embodiment, second tier 170 is generally triangular. However, one skilled in the art would understand and appreciate that second tier 170 could be configured in alternative shapes to complement alternative shapes of deck plate second tier 100 without deviating from the scope of the present invention.

Deck plate tiers 75, 100 and retaining grooves 95, 115, 120 are dimensioned and spaced, both laterally and vertically, to complement the dimensional and spacing aspects of truck plate tiers 145, 170 and rails 150, 185, 190, respectively, such that truck plate 15 may be slid longitudinally into deck plate 10 through the cooperation between deck plate tiers 75, 100 and the truck plate tiers 145, 170, respectively, and grooves 95, 115, 120 and rails 150, 185, 190, respectively.

Figure 14:
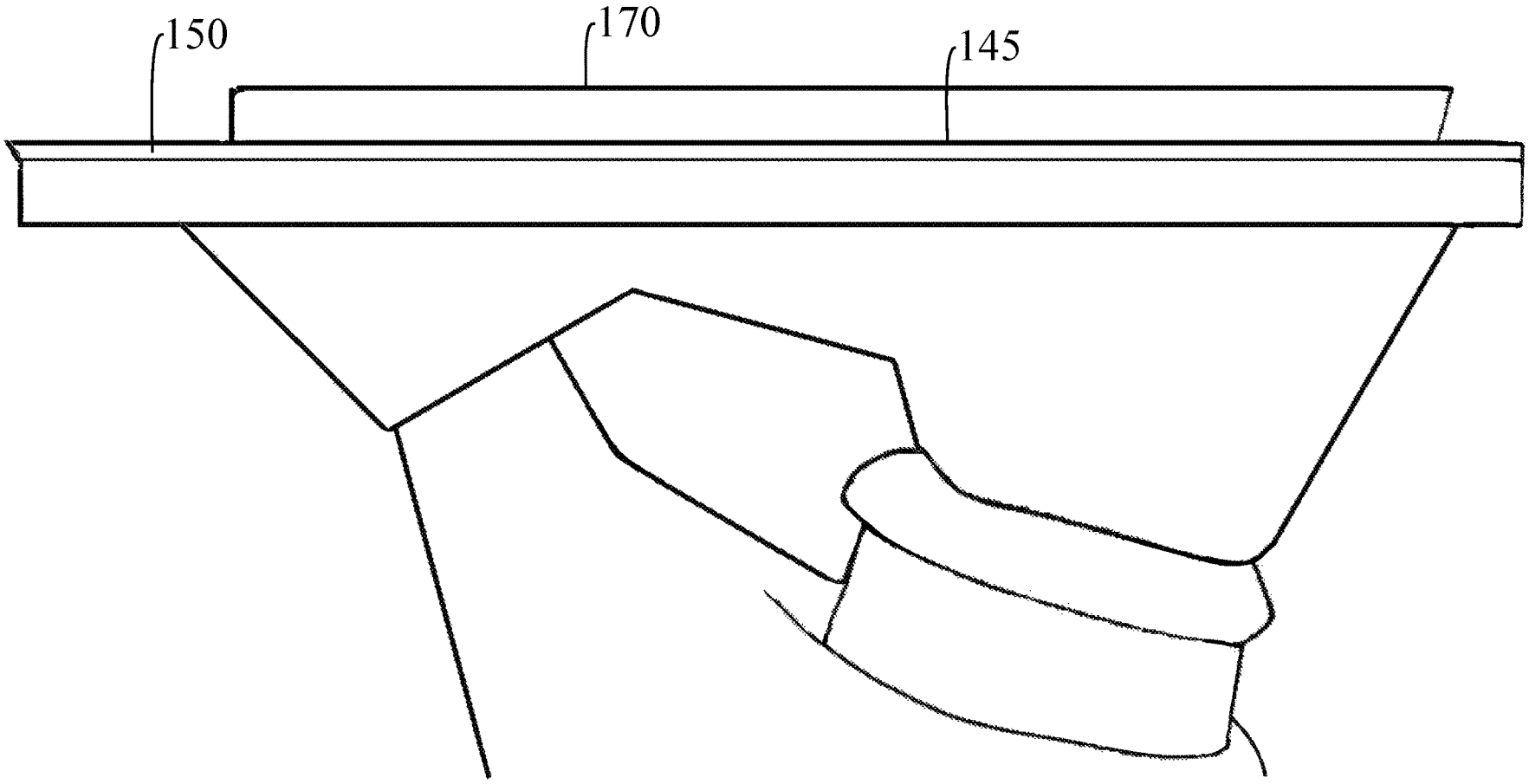
FIG. 14 shows a side elevational view of the truck plate integrated into the baseplate of a truck, according to an embodiment of the present invention.
Figure 15:
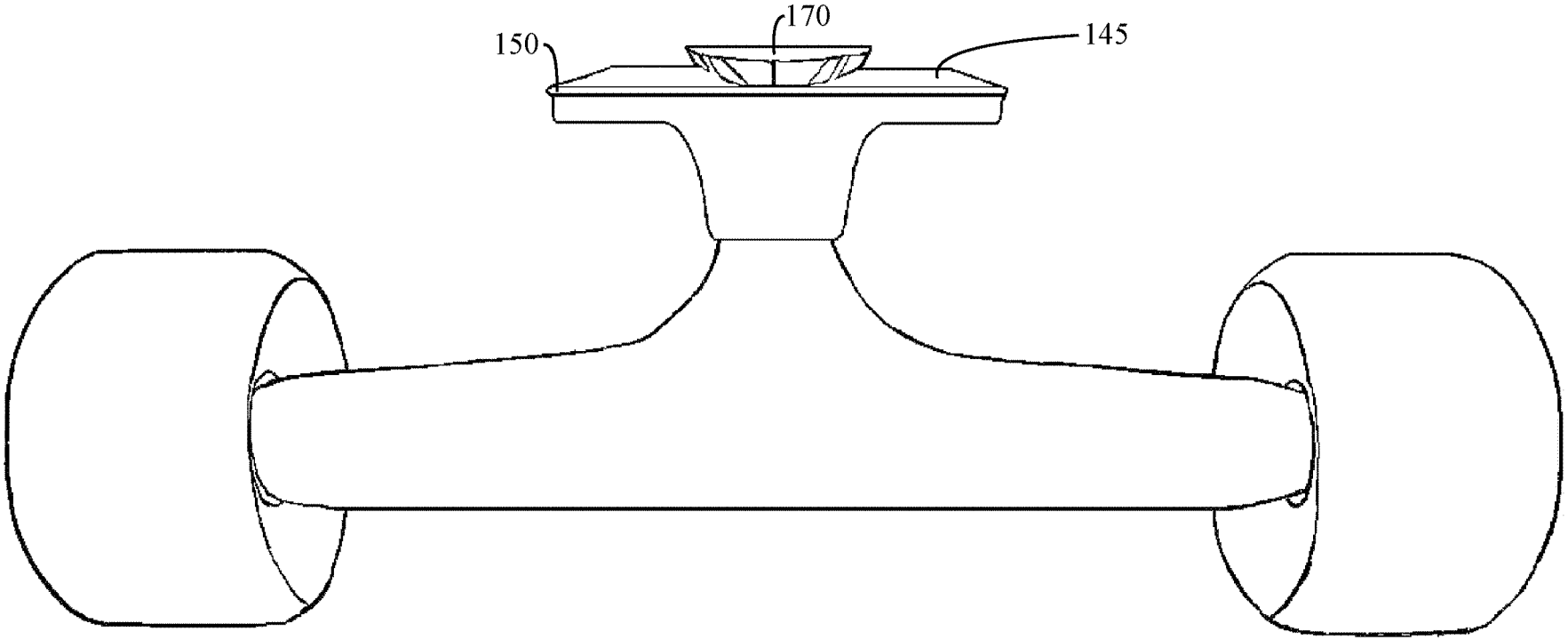
FIG. 15 shows a perspective view of the truck plate integrated into the baseplate of a truck, according to an embodiment of the present invention.

With reference to FIGS. 14-15, in an embodiment, truck plate 15 is an integrated, i.e., non-removable, element of the truck baseplate. During manufacture of the truck, the stepped configuration, including rails 150, 185, 190, of truck plate 15 are molded, formed, or otherwise machined as an integrated portion of the truck baseplate.

Lock Bars

With reference to FIGS. 16-22, lock bars 30, 35 are generally rectangular and are configured to be housed in lock bar channels 50, 55. When positioned in lock bar channels 50, 55, an uppermost surface of lock bars 30, 35 is disposed slightly lower than deck plate upper surface 45. Bottom of lock bars 30, 35 includes a stepped configuration, whereby a longitudinal span of central portion 31, 36 of lock bars 30, 35 is recessed, relative to the longitudinal spans of corresponding terminal portions 32, 33, 37, 38. The longitudinal span of central portions 31, 36 of lock bars 30, 35 are greater than the longitudinal span of central portions 53, 58 of lock bar channels 50, 55, respectively. Lock bar channels 50, 55 are configured to allow a pre-determined amount of longitudinal movement of lock bars 30, 35 when seated in place.

Spring 205 is disposed between a distal end of lock bars 30, 35 and a distal end of lock bar channels 50, 55, respectively. When lock bars 30, 35 are in their native, i.e., locked, position, spring 205 is partially compressed, such that it exerts an opposing force against lock bars 30, 35. As lock bars 30, 35 are forced inward against spring 205, it becomes further compressed, such that, when released, lock bars 30, 35 automatically return to their native position, due to the opposing force exerted by spring 205. Proximally-located edges 210, 215 of lock bar terminal portions 33, 38 are configured to matingly engage proximally-located edges 126, 131 of apertures 60, 65 to restrict rearward longitudinal movement of lock bars 30, 35 when returning to their native position. Similarly, distally-located edges 220, 225 of lock bar terminal portions 32, 37 are configured to matingly engage proximally-located edge 54, 59 of lock bar channel central portions 53, 58 to restrict forward longitudinal movement of lock bars 30, 35 when transitioning them to their unlocked position. A proximal end of lock bars 30, 35 protrudes from opposing sides of deck plate 10 when the lock bars 30, 35 are in their native position.

Figure 16:
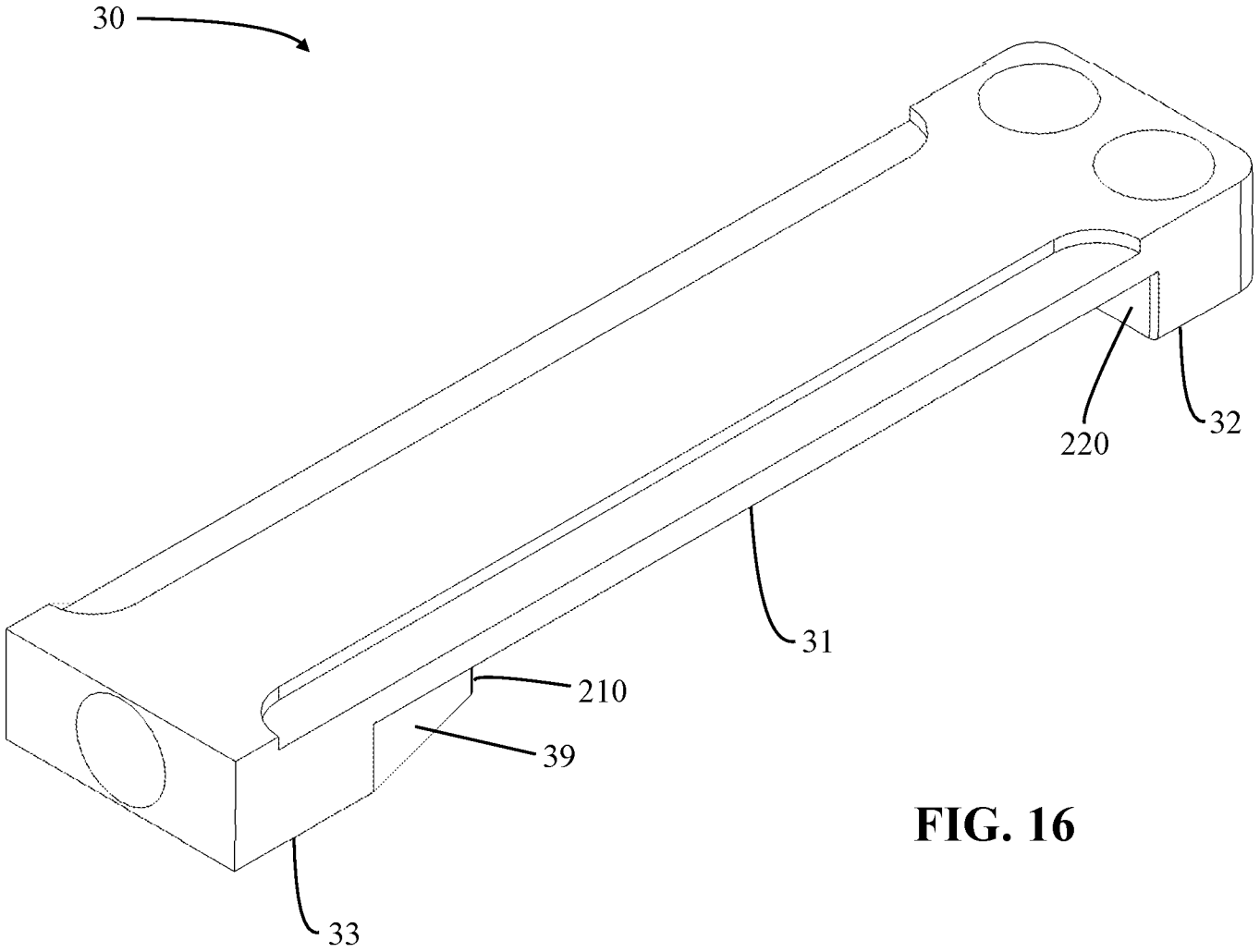
FIG. 16 shows a top perspective view of a lock bar, according to an embodiment of the present invention.
Figure 17:
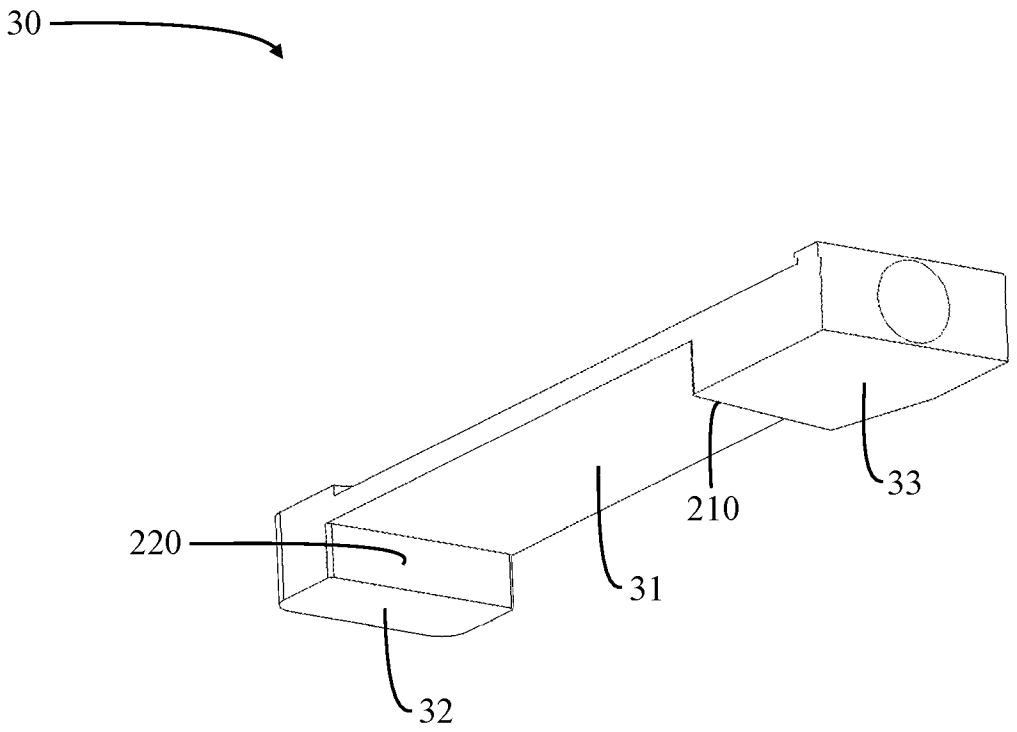
FIG. 17 shows a bottom perspective view of a lock bar, according to an embodiment of the present invention.
Figure 18:
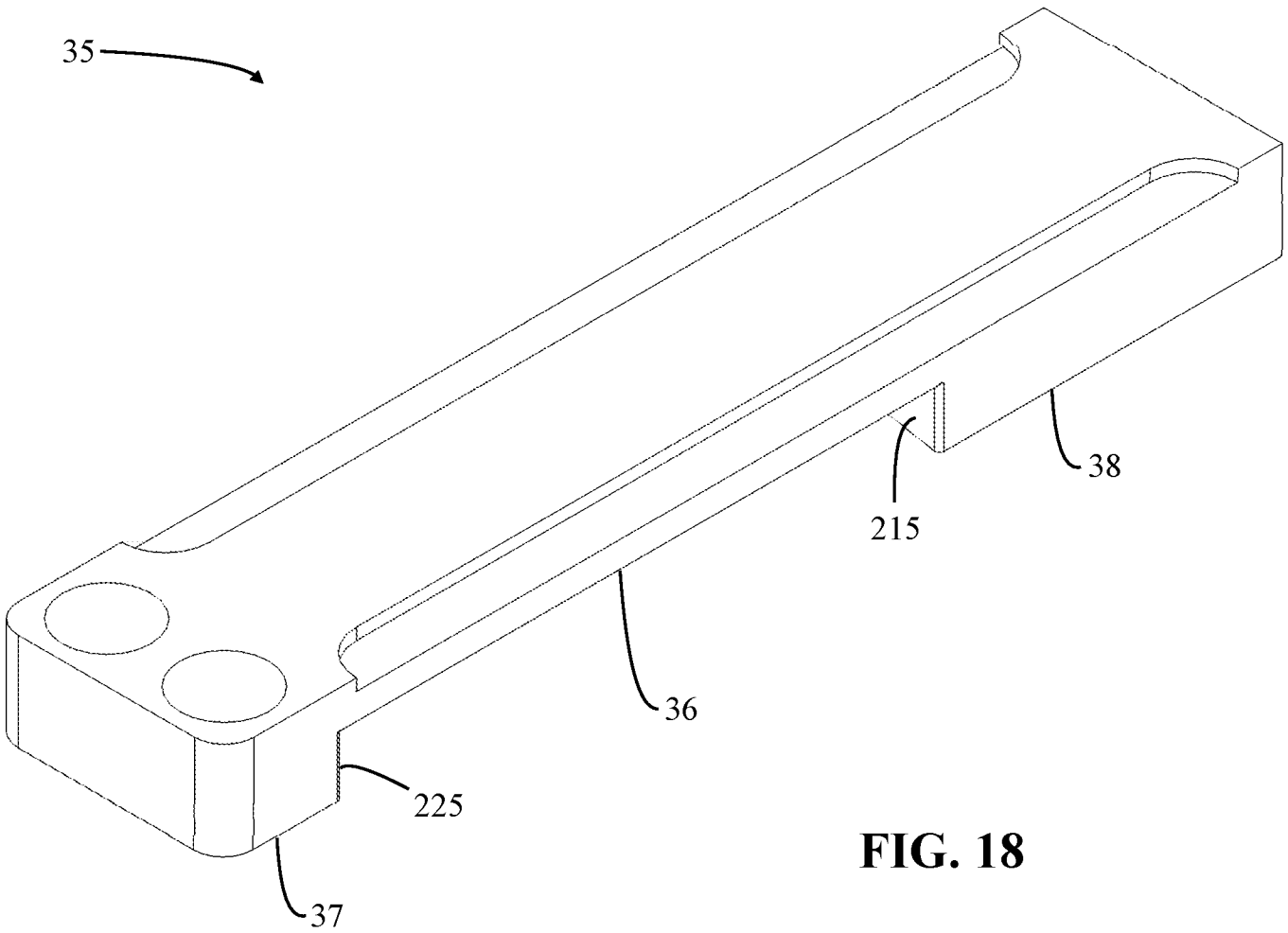
FIG. 18 shows a top perspective view of a lock bar, according to an embodiment of the present invention.
Figure 19:
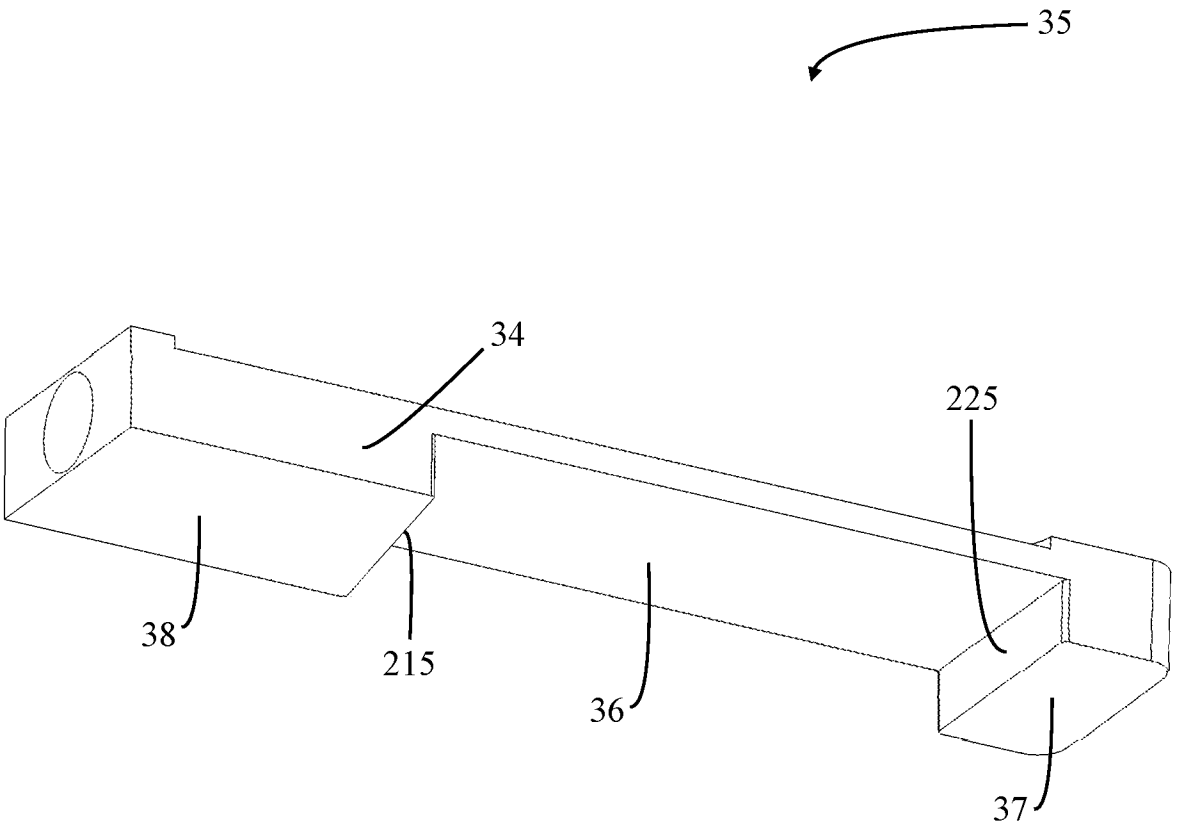
FIG. 19 shows a bottom perspective view of a lock bar, according to an embodiment of the present invention.

With reference to FIG. 16, in the preferred embodiment, left edge 39 of the distal portion of lock bar 30 that extends into and through aperture 60 is curved, rounded, or otherwise angled obliquely, relative to the longitudinal axis of lock bar 30. Side walls of lock stop 200 are configured to complement the distal portion of lock bar 30, including left edge 39 to create a wedge-like interaction between lock stop 200 and lock bar distal portion 33, resulting in multi-directional forces, i.e., lateral and longitudinal forces, being exerted on lock bar 30 as the opposing force of spring 205 is exerted on the distal end of lock bar 30.

In a further embodiment, the right edge of the distal portion of lock bar 30 and the left edge of the distal portion of lock bar 35 that extend into and through apertures 60, 65, respectively, are similarly configured to left edge 39, such that they are curved, rounded, or otherwise angled obliquely, relative to the longitudinal axis of lock bars 30, 35. This allows lock bars 30, 35 to cooperatively engage the distal portion of truck plate second tier 170 as truck plate 15 is inserted into deck plate 10 to facilitate moving lock bars 30, 35 further into lock bar channels 50, 55.

Method of Use

A method of using quick-release truck system 5 begins with attaching deck plate 10 to a given deck and, in the event truck plate 15 is not integrated into the truck base plate, attaching truck plate 15 to a given truck using non-permanent coupling means, such as screws or bolts (not shown). Once attached, the deck serves as a retaining barrier to prevent upward movement, or dislocation, of lock bars 30, 35 from lock bar channels 50, 55. Once deck plate 10 and truck plate 15 are coupled to the deck and truck, truck plate tiers 145, 170 and rails 150, 185, 190 are aligned with deck plate tiers 75, 100 and retaining grooves 95, 115, 120, respectively, at the open end of deck plate 10. Once aligned, truck plate 15 is slid longitudinally into deck plate 10 through the cooperation between deck plate tiers 75, 100 and truck plate tiers 145, 170, respectively, and deck plate grooves 95, 115, 120 and truck plate rails 150, 185, 190, respectively. As truck plate 15 is inserted into deck plate 10, the distal portion of second tier 170, configured to initiate contact with lock bars 30, 35, initiates said contact and forces lock bars 30, 35, in opposition to tension of spring 205, to recess into their respective lock bar channels 50, 55. Finally, as truck plate 15 slides into place on deck plate 10, i.e., when truck plate 15 is fully engaged with deck plate 10, lock stops 195, 200 align with apertures 60, 65, thereby allowing lock bars 30, 35 to return, by spring action, to their native, i.e., locked, position, whereby lock bar terminal portions 33, 38 seat in, and matingly engage lock stops 195, 200. Additionally, when truck plate 15 is fully engaged with deck plate 10, rail 150 is matingly engaged with groove 95 along three sides of quick-release truck system 5, and rails 185, 190 are matingly engaged with grooves 115, 120.

The process of removing, or disengaging, truck plate 15 from deck plate 10 is initiated by depressing the proximal end of lock bars 30, 35 to disengage lock bar terminal portions 33, 38 from lock stops 195, 200. Once fully disengaged, truck plate 15 can be slid longitudinally out of deck plate 10 through cooperation between deck plate tiers 75, 100 and truck plate tiers 145, 170, respectively, and deck plate grooves 95, 115, 120 and truck plate rails 150, 185, 190, respectively, thereby uncoupling truck plate 15 from deck plate 10.

The invention has been described herein using specific embodiments for the purposes of illustration only. It will be readily apparent to one of ordinary skill in the art, however, that the principles of the invention can be embodied in other ways. Therefore, the invention should not be regarded as being limited in scope to the specific embodiments disclosed herein, but instead as being fully commensurate in scope with the following claims.

I claim:

1. A quick-release truck system for a rideable vehicle comprising:

a) a deck plate configured to mount to an underside of a deck of the rideable vehicle, the deck plate including:
   i) one or more channels;
   ii) a cavity extending into a lower surface of the deck plate, the cavity having a plurality of vertically staggered grooves disposed therein, wherein the one or more channels are in open communication with the cavity; and b) a truck plate configured to mount to an upper surface of a truck baseplate, the truck plate including:
   i) a plurality of vertically-staggered rails dimensioned and spaced to complement the grooves; and
   ii) one or more lock stops extending into one or more of the rails; and c) locking means disposed within the one or more channels, wherein each of the locking means is configured to releasably engage the one or more lock stops, wherein the truck plate is configured to slidingly engage the deck plate, wherein once fully engaged, the truck plate releasably locks to the deck plate.

2. The system of claim 1, wherein the cavity and an upper surface of the truck plate have complementary tiered configurations, wherein the grooves and the rails are also staggered horizontally.

3. The system of claim 2, wherein at least one tier of the cavity and at least one tier of the truck plate's upper surface have a substantially triangular shape.

4. The system of claim 1, wherein one or more of the grooves extend along three contiguous surfaces of the cavity, and wherein one or more of the rails extend along three contiguous surfaces of the truck plate.

5. The system of claim 1, wherein the one or more channels include a second channel, wherein the channels extend into opposing sides of the deck plate.

6. The system of claim 1, wherein each of the one or more channels extend into a side and an upper surface of the deck plate.

7. The system of claim 6, wherein the one or more channels include a second channel, wherein the channels extend into opposing sides of the deck plate.

8. The system of claim 1, wherein the truck plate and the deck plate further include one or more cut-outs configured to reduce an overall weight of the system.

9. A quick-release truck system for a rideable vehicle comprising:

a) a deck plate configured to mount to an underside of a deck of the rideable vehicle, the deck plate including:
   i) one or more channels;
   ii) a cavity extending into a lower surface of the deck plate, the cavity having a plurality of vertically-staggered grooves disposed therein, wherein the one or more channels are in open communication with the cavity; and b) a truck having a baseplate, the baseplate including:
   i) a plurality of vertically-staggered rails dimensioned and spaced to complement the grooves; and
   ii) one or more lock stops extending into one or more of the rails; and c) locking means disposed within the one or more channels, wherein each of the locking means is configured to releasably engage the one or more lock stops, wherein the baseplate is configured to slidingly engage the deck plate, wherein once fully engaged, the baseplate releasably locks to the deck plate.

10. The system of claim 9, wherein the cavity and an upper surface of the baseplate have complementary tiered configurations, wherein the grooves and the rails are also staggered horizontally.

11. The system of claim 10, wherein at least one tier of the cavity and at least one tier of the baseplate's upper surface have a substantially triangular shape.

12. The system of claim 9, wherein one or more of the grooves extend along three contiguous surfaces of the cavity, and wherein one or more of the rails extend along three contiguous surfaces of the baseplate.

13. The system of claim 9, wherein the one or more channels include a second channel, wherein the channels extend into opposing sides of the deck plate.

14. The system of claim 9, wherein the one or more channels extend into a side and an upper surface of the deck plate.

15. The system of claim 14, wherein the one or more channels include a second channel, wherein the channels extend into opposing sides of the deck plate.

16. The system of claim 15, wherein the truck plate and the deck plate further include one or more cut-outs configured to reduce an overall weight of the system.

17. A quick-release truck system for a rideable vehicle comprising:

a) a deck plate including a plurality of vertically-staggered first coupling means;

b) a truck plate including a plurality of vertically-staggered second coupling means dimensioned and spaced to complement the first coupling means; and c) locking means configured to releasably couple the truck plate to the deck plate, wherein the truck plate is configured to slidingly engage the deck plate, wherein once fully engaged, the truck plate releasably locks to the deck plate.

18. The system of claim 17, wherein the deck plate and the truck plate include complementary tiered configurations, wherein the first coupling means and the second coupling means are also staggered horizontally.

19. The system of claim 17, wherein one or more of the first coupling means extend along three contiguous surfaces of the deck plate, and wherein one or more of the second coupling means extend along three contiguous surfaces of the truck plate.

20. The system of claim 17, wherein the truck plate and the deck plate further include one or more cut-outs configured to reduce an overall weight of the system.

* * * * *